United States Patent [19]

Fukukura

[11] Patent Number: 4,460,810

[45] Date of Patent: Jul. 17, 1984

[54] KEYBOARD SWITCH HAVING INTEGRAL BEZEL

[75] Inventor: Kazutoyo Fukukura, Reading, Mass.

[73] Assignee: AMP Incorporated, Harrisburg, Pa.

[21] Appl. No.: 506,162

[22] Filed: Jun. 20, 1983

[51] Int. Cl.[3] ..... H01H 13/70

[52] U.S. Cl. ..... 200/5 A; 200/159 B; 200/303

[58] Field of Search ..... 200/5 R, 5 A, 159 B, 200/275, 303, 46, 292

[56] References Cited

U.S. PATENT DOCUMENTS

| | | | |
|---|---|---|---|
| 4,158,115 | 6/1979 | Parkinson et al. | 200/5 A |
| 4,180,711 | 12/1979 | Hirata et al. | 200/5 A |
| 4,194,099 | 3/1980 | Mickelson | 200/5 A |

*Primary Examiner*—J. R. Scott

*Attorney, Agent, or Firm*—F. W. Raring

[57] ABSTRACT

Keyboard switch assembly comprises first and second insulating supports having opposed spaced-apart first and second surfaces. The first support is a flexible film and has circuit conductors on the first surface thereof which extend to switch sites. Each switch site has a pair of spaced-apart switch electrodes. The second support is a rigid one piece molding having a bezel which surrounds a sunken surface. The first surface of the first support is disposed against the sunken surface. The sunken surface has recesses therein at the switch sites and the floors of the recesses are covered with conductive material such as conductive ink. The floors of the recesses are the second surface. A switch at a switch site is closed by pressing on the first support so that spaced-apart electrodes both contact the conductive material on the floor of the associated recess in the sunken surface of the second support.

6 Claims, 7 Drawing Figures

KEYBOARD SWITCH HAVING INTEGRAL BEZEL

FIELD OF THE INVENTION

The invention relates to keyboard switch assemblies of the general type comprising first and second supports having opposed spaced-apart surfaces and having circuit conductors and spaced-apart switch electrodes on one of the supports. The other support has commoning conductors at the switch site. Keyboard switch assemblies of this type also have a backer plate and a bezel which surrounds the supports. The present invention is directed to a keyboard switch assembly of simplified construction having only two essential parts.

BACKGROUND OF THE INVENTION

A conventional type of keyboard switch assembly comprises first and second insulating supports having opposed normally spaced-apart first and second surfaces. The first surface has circuit conductors thereon which extend between and among a plurality of spaced-apart switch electrodes at individual switch sites. The second support has commoning conductors at the switch site so that when the two associated electrodes contact the commoning conductor, the switch at the switch site is closed. A separator is required to normally maintain the first support in spaced relationship to the second support and the separator has openings therein at the switch sites to permit the switch to be closed.

In addition to the first and second supports and the separator, a conventional keyboard switch assembly will ordinarily have a firm backer plate on which the two supports are mounted and a molded bezel which surrounds the supports and which is fastened to the backer plate by fasteners or by an adhesive.

Since low production cost is a desirable feature in keyboard switch assemblies, it would be desirable to reduce the number of parts in an assembly and simplify the manufacturing process for the keyboard switch assembly. The present invention is directed to the achievement of a simplified keyboard switch assembly which can be produced at a minimum cost.

A keyboard switch assembly in accordance with the invention comprises a housing having a keyboard face, a plurality of switch sites on the keyboard face and first and second parallel conductor supports which extend parallel to the keyboard face. The supports have spaced-apart first and second opposed surfaces respectively, the first surface having circuit conductors thereon and having a plurality of pairs of spaced-apart switch electrodes. Each pair of switch electrodes is in alignment with one of the switch sites and the circuit conductors extend to the switch sites. The second surface has a plurality of commoning conductors thereon, each commoning conductor being opposed to one of the pairs of switch electrodes. The first support is flexible so that upon application of a switch closing force to one of the switch sites on the keyboard face, the switch electrodes associated with the switch site are contacted with the associated commoning conductor and the switch is closed. The switch assembly is characterized in that the second conductor support is of firm molded plastic material and has a planar separator surface which is opposed to, and substantially against, the first surface of the first support. The separator surface has recesses therein at the switch sites, the recesses having recess surface which are parallel to the first surfaces. The commoning conductors are on the recess surfaces, the recess surfaces being the second surface of the switch assembly. The second conductor support has a bezel integrally molded therewith which surrounds the separator surface and the first support is secured within the bezel.

In accordance with further embodiments, the first support has a tail extending therefrom and at least some of the circuit conductors extend onto the tail. The bezel has a slot therein extending from the separator surface and the tail extends through the slot. The support surface is sunken in the bezel and the bezel has a boundary surface which extends normally of, and circumscribes, the support surface. The bezel has a plurality of openings extending into the boundary surface and the first support has retaining extensions which extend into the openings for retaining the first support against the separator surface.

In accordance with further embodiments, the first surface has intervening circuit conductors extending between the two switch electrodes of at least one pair of switch electrodes and the associated commoning conductor comprises spaced-apart commoning pads and a connecting conductor which extends between the commoning pads. The associated recess has at least one boss extending from the recess surface thereof. The boss prevents contacting of the commoning pads and the connecting conductor by the intervening circuit conductors. In one embodiment, the boss has a non-conductive surface which is opposed to the intervening circuit conductors and the connecting conductor extends on the recess surface from one of the commoning pads around the boss and to the other commoning pad. In an alternative embodiment, the associated recess has a pair of spaced-apart bosses extending from the recess surface. The spaced-apart bosses have contact surfaces which are opposed to the switch electrodes and which are between the recess surface and the separator surface. In this alternative embodiment, the recess surface, the contact surfaces, and sides of the bosses extending from the contact surfaces to the recess surface all have conductive material thereon.

DESCRIPTION OF THE PREFERRED EMBODIMENT

Figure 1:
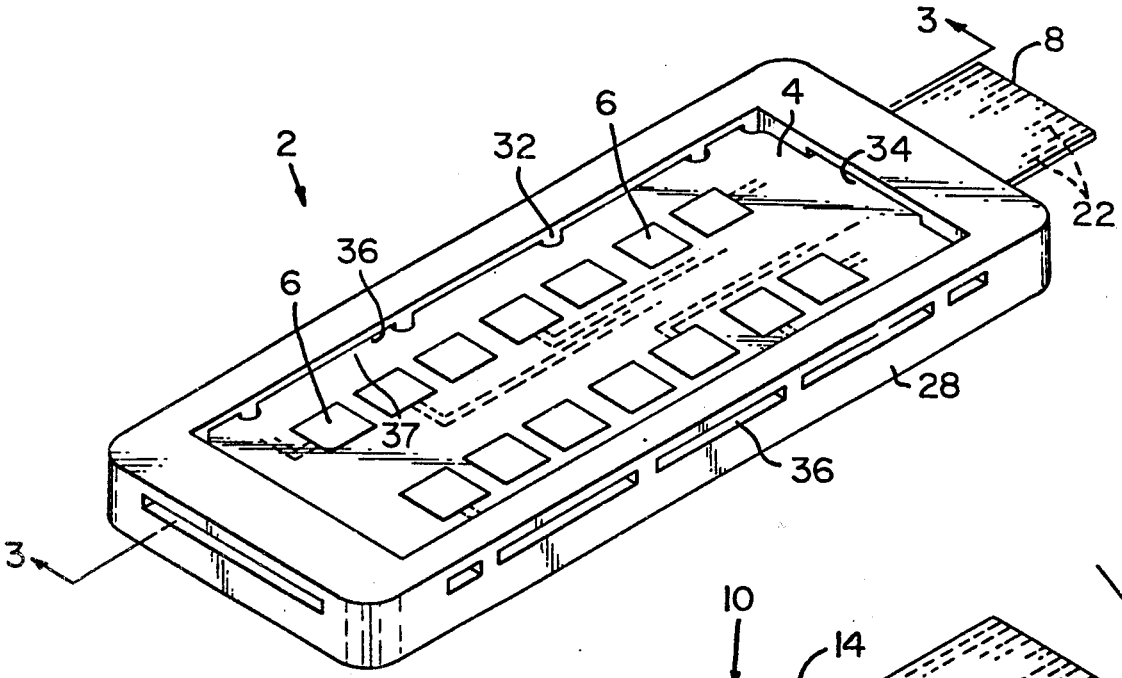
FIG. 1 is a perspective view of a keyboard switch assembly in accordance with the invention.
Figure 2:
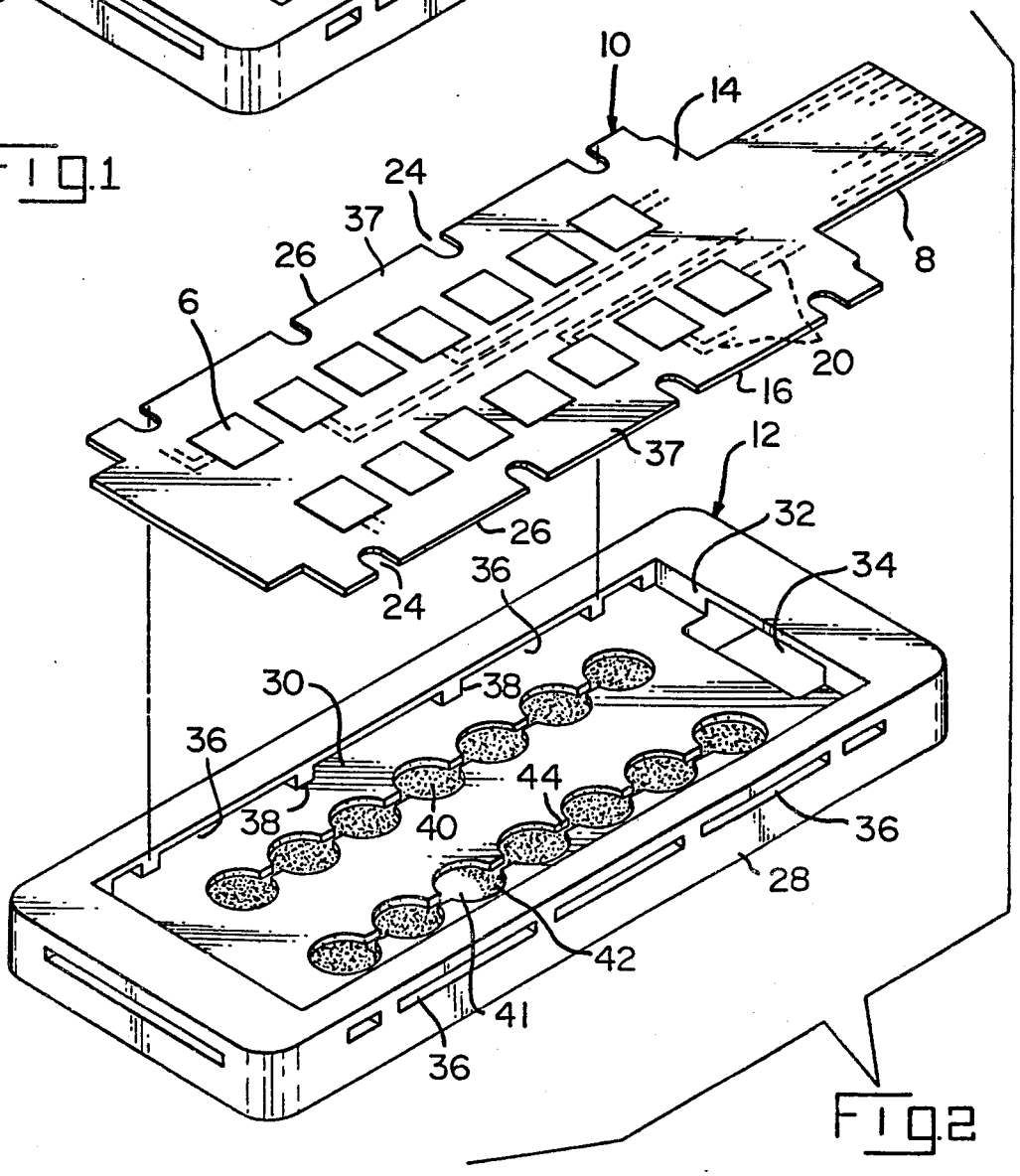
FIG. 2 is a view similar to FIG. 1 but showing the first support exploded from the second support.
Figure 3:
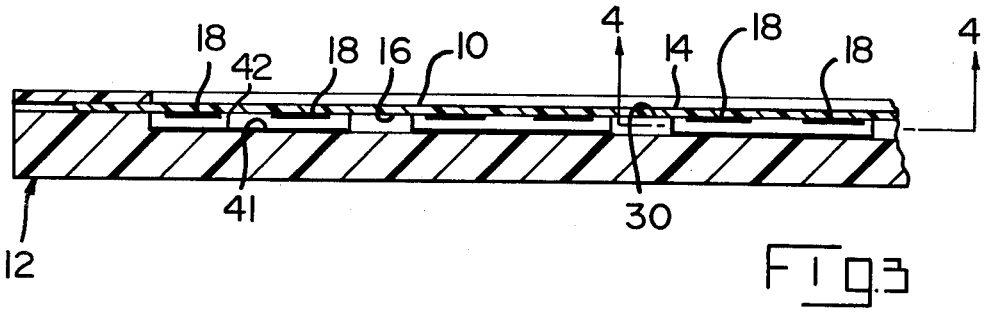
FIG. 3 is a view taken along the lines 3—3 of FIG. 1.
Figure 4:
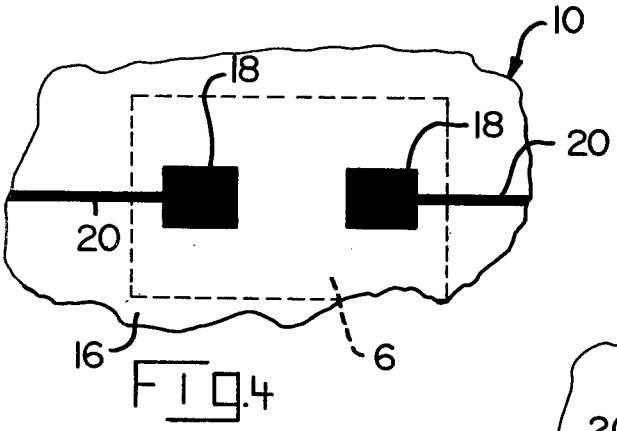
FIG. 4 is a view taken along the lines 4—4 of FIG. 3.

A switch assembly 2 in accordance with the invention has a switch face 4 surrounded by a bezel described below and having a plurality of switch sites 6 thereon. The switch sites may be identified by suitable graphics such as numbers, letters, or symbols. A tail 8 extends from the assembly and has conductors 22 thereon which carry the appropriate encoded signals when a particular switch site 6 is pressed.

The assembly 2 comprises first and second insulating supports 10, 12. The first support 10 is a flexible insulating film such as polyester having an upper surface 14 and a lower surface 16. The switch sites may be identified by graphics on the upper surface 14 and a plurality of circuit conductors 20 are provided on the lower surface 16. The conductors extend between and among pairs of switch electrodes 18 which are provided at each switch site. When a switch at a particular site is to be closed, these electrodes will be electrically connected in a manner described below. The circuit conductors also extend to the previously identified conductors 22 on the underside of the tail 8. The side edges 26 of the first support 10 are provided with notches 24 by means of which it is assembled to the second support 12.

The second support 12 comprises a one piece molding of firm plastic material, preferably a thermoplastic and has a rectangular bezel 28 which surrounds a sunken separator surface 30. A barrier wall 32 extends normally of the surface 30 to the surface of the bezel and confines the first support with respect to the second support. A tail slot 34 extends from the separator surface 30 through the barrier wall 32 at one end of the bezel so that the tail can be inserted through this slot and then connected to further circuitry which is controlled by the switch assembly. Openings or bezel slots 36 are provided in the barrier wall 32 along the side of the bezel and are separated from each other by spaced-apart ribs 38. The notches 24 are dimensioned to receive the ribs 38 and the first support can therefore be assembled to the second support 10 by merely inserting the tail 8 through the slot 34 and inserting marginal side edge portions 37 of the first support 10 into the openings 36. An additional adhesive may be used if desired but will not be necessary if the interlocking notches and ribs are properly designed.

Recesses 40 are provided in the separator surface 30 at each of the switch sites and each recess has a recess surface or floor 41 which is covered with a conductive material 42. The conductive material 42 is advantageously applied to the surfaces 41 by transfer printing or another suitable process. Passageways 44 extend between adjacent recesses to permit the flow of air between the adjacent switch sites when the first support 10 is pressed at a particular switch site. These passageways thus avoid resistance to closure of the switch because of the compression of the air in the recess.

From the foregoing, it will be apparent that the entire manufacturing process for the switch assembly of FIG. 1 merely requires preparation of the first and second supports 10, 12, and assembly of the first support 10 to the second support 12 by insertion of the tail 8 through the slot 34 and positioning of the support against the separator surface 30. The marginal side portions 37 of the first support 10 are positioned in the bezel slots 36 by flexing the first support to reduce its width, inserting portions 37 into bezel slots 36, and allowing the first support to return to its flat unflexed condition. These marginal portions thus serve as retaining extensions. It is not necessary to provide a separate base plate and bezel as is common practice in the manufacture of existing switches.

Figure 5:
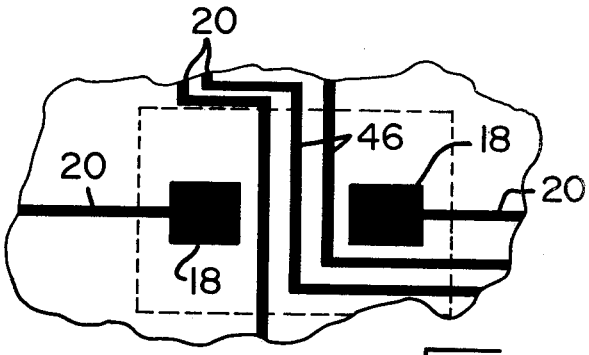
FIG. 5 is a view similar to FIG. 4 showing an alternative embodiment.

FIG. 5 shows an embodiment in which selected circuit conductors 20 have portions 46 which extend between the spaced-apart electrodes 18 at one or more of the switch sites. This technique of routing circuit conductors between the spaced-apart electrodes 18 is desirable if the surface 14 is crowded with many circuit conductors 20 and frequently it is not possible to produce a desired circuit unless crossovers are provided or the circuit routing technique of FIG. 5 is used.

Figure 6:
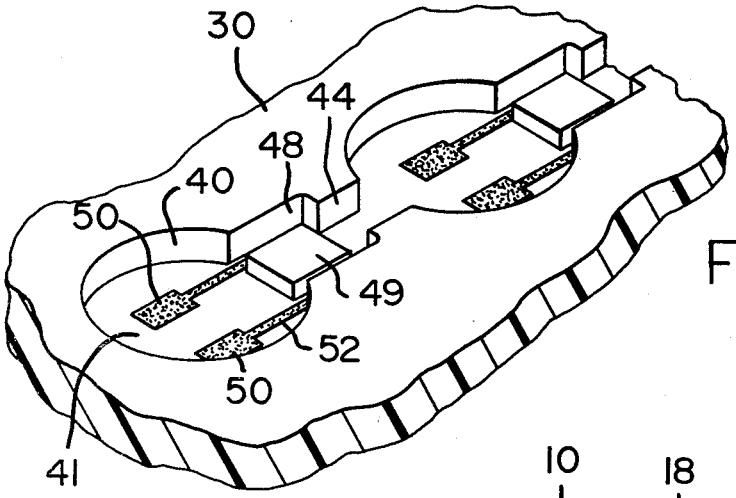
FIG. 6 is a fragmentary perspective view showing a portion of the support surface of the second support of an alternative embodiment intended for use with the embodiment of FIG. 5.
Figure 7:
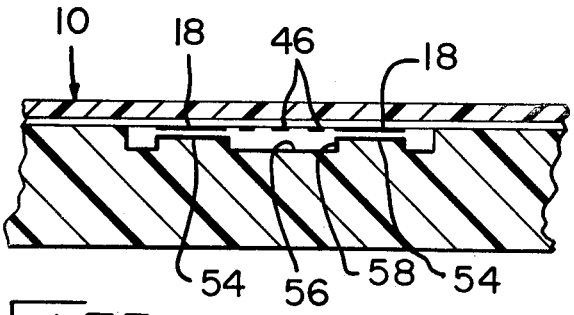
FIG. 7 is a cross-sectional view taken at a switch site of a further embodiment.

If the routing technique having intervening conductors 46 at a switch site is used, it is necessary that the commoning conductor for the switch site shown in FIG. 5 should not contact the conductors 46 when the switch is closed but it must contact only the electrodes 18. FIG. 6 shows one type of commoning conductor for use with the circuit routing technique of FIG. 5 which will not result in contacting of the conductors 46. In FIG. 6, each recess 40 has an extension 48 in which there is provided a boss 49. Each commoning conductor comprises spaced-apart commoning pads 50, which are opposed to the electrodes 18, and a connecting conductor 52. The connecting conductor extends from one of the commoning pads 50 into the extension 48 of the recess 40, around the boss 49, and then to the other commoning conductor. The upper surface of the boss 49 is above the recess surface 41 but beneath the separator surface 30 and this boss, coupled with the piece of the commoning conductor 50, 52, will prevent contacting of the conductors 46 when the switch is closed. FIG. 7 shows another embodiment which permits the use of intervening conductors 46 between the switch electrodes 18 on the surface 16. In the embodiment of FIG. 7, the recess has a pair of spaced-apart bosses 54 extending from the recess floor 41 which have upper surfaces that are opposed to, but spaced from, the electrodes 18. Conductive material such as conductive ink is provided on the upper surfaces of bosses 54, on the floor 41 of the recess as shown at 56, and on the sidewalls 58 of the bosses. It will be apparent from an inspection of FIG. 7 that when the first support 10 is flexed downwardly at the switch site, the conductors 46 will not be contacted with the conductive material in the recess but the electrodes will both be contacted with the conductive material on the surfaces 54 and the switch will be closed.

It will be apparent from the foregoing that the practice of the invention permits the manufacture of the keyboard switch assemblies by providing only two parts, one a rigid molding, and the other a membrane having circuitry on one surface, and assembling the parts to each other. The resulting assembly has all of the features of a conventional keyboard assembly which is ordinarily of four or five parts.

I claim:

1. A keyboard switch assembly of the type comprising a housing having a keyboard face, a plurality of switch sites on the keyboard face, first and second parallel conductor supports which extend parallel to the keyboard face, the supports having spaced-apart first and second opposed surfaces respectively, the first surface having circuit conductors thereon and having a plurality of pairs of spaced-apart switch electrodes, each pair of switch electrodes being in alignment with one of the switch sites, the circuit conductors extending to the switch sites, the second surface having a plurality of commoning conductors thereon, each commoning conductor being opposed to one of the pairs of switch electrodes, the first support being a continuous flexible insulating film so that upon application of a switch closing force to one of the switch sites on the keyboard face, the switch electrodes associated with the switch site are contacted with the associated commoning conductor thereby closing the switch, the switch assembly being characterized in that:

the second conductor support is firm molded plastic material and has a planar separator surface which is opposed to, and substantially against, the first surface of the first support, the separator surface having recesses therein at the switch sites, the recesses having recess surfaces which are parallel to the first surfaces, the commoning conductors being located on the recess surfaces, the recess surfaces constituting the second surface of the switch assembly, the second conductor support having a bezel integrally molded therewith, the bezel surrounding the separator surface, the support surface being sunken in the bezel and the bezel having a boundary surface which extends normally of, and circumscribes, the support surface, the bezel having a plurality of bezel slots extending into the boundary surface, the first support having flexible retaining extensions which extend into the bezel slots for retaining the first support against the separator surface, and the first support has a flexible tail extending therefrom, at least some of the circuit conductors extending onto the tail, the bezel having a tail slot therein extending from the separator surface, the tail extending through the tail slot.

2. A keyboard switch assembly as set forth in claim 1 characterized in that the first support has an external surface, the external surface having graphics thereon at the switch sites.

3. A keyboard switch assembly as set forth in claim 1 characterized in that the first surface has intervening circuit conductors extending between the two switch electrodes of at least one pair of switch electrodes, the associated commoning conductor comprising spaced-apart commoning pads and a connecting conductor which extends between the commoning pads, the associated recess having at least one boss extending from the recess surface thereof, the boss preventing contacting of the commoning pads and the connecting conductor by the intervening circuit conductors.

4. A keyboard switch assembly as set forth in claim 3 characterized in that the boss has a non-conductive surface which is opposed to the intervening circuit conductors.

5. A keyboard switch assembly as set forth in claim 4 characterized in that the connecting conductor extends on the recess surface from one of the commoning pads around the boss and to the other commoning pad.

6. A keyboard switch as set forth in claim 3 characterized in that the associated recess has a pair of spaced-apart bosses extending from the recess surface, the spaced-apart bosses having contact surfaces which are opposed to the switch electrodes and which are between the recess surface and the separator surface, the recess surface, the contact surfaces, and sides of the bosses extending from the contact surfaces to the recess surface having conductive material thereon.

* * * * *